US012303796B2

(12) United States Patent
Kerwin

(10) Patent No.: US 12,303,796 B2
(45) Date of Patent: May 20, 2025

(54) PORTABLE GAME BOARD

(71) Applicant: Lewis Kerwin, Seattle, WA (US)

(72) Inventor: Lewis Kerwin, Seattle, WA (US)

( * ) Notice: Subject to any disclaimer, the term of this patent is extended or adjusted under 35 U.S.C. 154(b) by 608 days.

(21) Appl. No.: 17/688,278

(22) Filed: Mar. 7, 2022

(65) Prior Publication Data

US 2022/0280864 A1 Sep. 8, 2022

Related U.S. Application Data

(60) Provisional application No. 63/157,283, filed on Mar. 5, 2021.

(51) Int. Cl.
*A63F 3/00* (2006.01)

(52) U.S. Cl.
CPC ..... *A63F 3/0023* (2013.01); *A63F 3/00574* (2013.01); *A63F 2003/00252* (2013.01); *A63F 2003/00258* (2013.01); *A63F 2003/0063* (2013.01); *A63F 2250/601* (2013.01)

(58) Field of Classification Search
CPC ..... A63F 3/0023; A63F 2003/00246; A63F 2003/00249; A63F 2003/00252; A63F 2003/00258
USPC ..... 273/285, 286, 287
See application file for complete search history.

(56) References Cited

U.S. PATENT DOCUMENTS 538,380 A * 4/1895 McKenzie ..... A63F 3/0023 273/286
724,760 A * 4/1903 Van Altena ..... A63F 3/0023 273/286
2,221,267 A * 11/1940 Robertson ..... A63F 3/00895 273/285
5,244,212 A * 9/1993 Bendit ..... A63F 3/02 273/285
5,490,675 A * 2/1996 Persidsky ..... A63F 3/00694 273/287
6,196,546 B1 * 3/2001 Iglesias ..... A63F 3/0023 273/287
6,203,017 B1 * 3/2001 Schultz ..... A63F 3/0023 273/287

(Continued)

OTHER PUBLICATIONS

Handmade Limited Edition Portable Chess Sett, Travel Set, Wooden Chess Pieces, Special Box, Sewing Leather Pattern—downloaded from Etsy Mar. 21, 2022 https://www.etsy.com/listing/947895886/handmade-limited-edition-portable-chess?click_key=236bf4fe2d2d3ff09d1b9ed87b3434c5c0cf3345%3A947895886&click_sum=d5eb81cd&ref=shop_home_recs_2&pro=1&frs=1&sts=1.

(Continued)

*Primary Examiner* — Joseph B Baldori
(74) *Attorney, Agent, or Firm* — Lloyd & Mousilli; Benjamin M. Hanrahan

(57) ABSTRACT

Provided herein are various types of foldable game boards and foldable objects which include a plurality of elongated base panels each of which has an inner surface, an outer surface, and a side panel oriented perpendicularly on each end. The inner surface is capable securely holding game pieces when in an open configuration. The game boards and objects described herein can be folded to a closed configuration to form a hollow polygonal prism. This configuration gives rise to a space for the storage of pieces on the inner surface of the elongated base panels during closed configuration and includes magnetic plates underneath for the purpose of holding pieces in place to save the game state at any point.

18 Claims, 15 Drawing Sheets

(56) References Cited

U.S. PATENT DOCUMENTS

| | | | | |
|---|---|---|---|---|
| 6,572,436 | B1 * | 6/2003 | So | A63H 17/44 446/478 |
| 6,796,561 | B2 * | 9/2004 | Bedford | A63F 3/0023 273/262 |
| 6,991,232 | B1 * | 1/2006 | Yufa | A63F 3/02 273/285 |
| 7,096,797 | B2 * | 8/2006 | Sharpe | A63F 3/0023 108/43 |
| 7,568,702 | B2 * | 8/2009 | Holden | A63F 3/00895 273/287 |
| 7,654,531 | B2 * | 2/2010 | Collins | A63F 3/0023 273/287 |
| 8,434,428 | B2 * | 5/2013 | Reiter | A01K 15/027 119/702 |
| 10,455,921 | B2 * | 10/2019 | Kesler | A45F 3/02 |
| 2002/0105143 | A1 | 8/2002 | Elliott et al. | |
| 2007/0216095 | A1 | 9/2007 | Jacobs | |
| 2007/0235929 | A1 | 10/2007 | Nip | |

OTHER PUBLICATIONS

CHESSBYINDIA_ 7.5" by 7.5" Ultimate Wooden Magnetic Travel Chess Set—downloaded from Etsy Mar. 21, 2022 https://www.etsy.com/listing/1082873233/75x75-ultimate-wooden-magnetic-travel?click_key=9cde107a1619df8b022e8b4606ec620a1a4bd132%3A1082873233&click_sum=e79adab0&ref=landingpage_similar_listing_bot-4&pro=1&frs=1.

Vincente Oak Wood Folding Mancala Board Game, 18 Inch Set—downloaded from Amazon Mar. 21, 2022 https://www.amazon.com/Vicente-Wood-Folding-Mancala-Board/dp/B01JBFOTDI.

* cited by examiner

PORTABLE GAME BOARD

CROSS REFERENCE TO RELATED APPLICATIONS

This application claims priority to U.S. Provisional Patent Application No. 63/157,283, filed Mar. 5, 2021, the contents of which is incorporated herein by reference in its entirety.

TECHNICAL FIELD

The present invention is in the field of game boards.

BACKGROUND OF THE INVENTION

Board games are a beloved pastime that bring people together to enjoy a break from real life. Unfortunately, real life can get in the way and the game must stop before it is finished. Previously, people would just leave the game pieces on the game board and pick the game back up when they had time. But this is not always possible. For example, the owner of the game board might have to go home and needs to take the game with them. Moving a stationary game board without altering the state of the game is nearly impossible. This would cause the game pieces and game board to be cleaned up and put away, losing the game state forever. Therefore, new ways to travel with a game board, pause the game, and pick it back up are needed. The disclosed invention is directed to these and other important needs.

SUMMARY OF THE INVENTION

The present invention provides for foldable game boards, comprising: a plurality of elongated base panels, each elongated base panel comprising an inner surface, an outer surface, and a side panel oriented perpendicularly at each end; a folding mechanism on each inner surface connecting edgewise each of the plurality of elongated base panels, allowing each of the plurality of elongated panels to fold against an adjacent elongated base panel to form open and closed configurations; the open configuration comprising the plurality of elongated base panels lying coplanar, wherein the plurality of inner surfaces forms and displays a game board capable of holding game pieces in place; the closed configuration comprising the plurality of elongated base panels angled to form a hollow polygonal prism capable of storing game pieces on the enclosed inner surfaces without disrupting their placement.

The present invention also provides for foldable game boards, comprising: a plurality of elongated base panels, wherein each elongated base panel comprises an inner surface, an outer surface, and a side panel oriented perpendicularly at each end; a folding mechanism on each inner surface connecting edgewise each of the plurality of elongated base panels, allowing each of the plurality of elongated panels to fold against an adjacent elongated base panel to form open and closed configurations; the open configuration comprising the plurality of elongated base panels lying coplanar, wherein the plurality of inner surfaces forms and displays a game board capable of holding game pieces in place; the closed configuration comprising the plurality of elongated base panels angled to form a hollow polygonal prism, wherein each side panel interlocks with an adjacent side panel, capable of storing game pieces on the enclosed inner surfaces without disrupting their placement.

The present invention further provides for foldable game boards, comprising: a plurality of elongated base panels, wherein each elongated base panel comprises a substantially flat inner surface, an outer surface, and a side panel oriented perpendicularly at each end; a folding mechanism underneath each substantially flat inner surface, connecting edgewise each of the plurality of elongated base panels, allowing each of the plurality of elongated panels to fold in one direction against an adjacent elongated base panel to form open and closed configurations; the open configuration comprising the plurality of elongated base panels lying coplanar, wherein the plurality of substantially flat inner surfaces forms and displays a game board capable of holding game pieces in place; the closed configuration comprising the plurality of elongated base panels angled to form a hollow polygonal prism capable of storing game pieces on the enclosed inner surfaces without disrupting their placement.

The general description and the following detailed description are exemplary and explanatory only and are not restrictive of the invention, as defined in the appended claims. Other aspects of the present invention will be apparent to those skilled in the art in view of the detailed description of the invention as provided herein.

BRIEF DESCRIPTION OF THE DRAWINGS

The summary, as well as the following detailed description, is further understood when read in conjunction with the appended drawings. For the purpose of illustrating the invention, there are shown in the drawings exemplary embodiments of the invention; however, the invention is not limited to the specific methods, compositions, and devices disclosed. In addition, the drawings are not necessarily drawn to scale. In the drawings.

DETAILED DESCRIPTION OF ILLUSTRATIVE EMBODIMENTS

Figure 1:
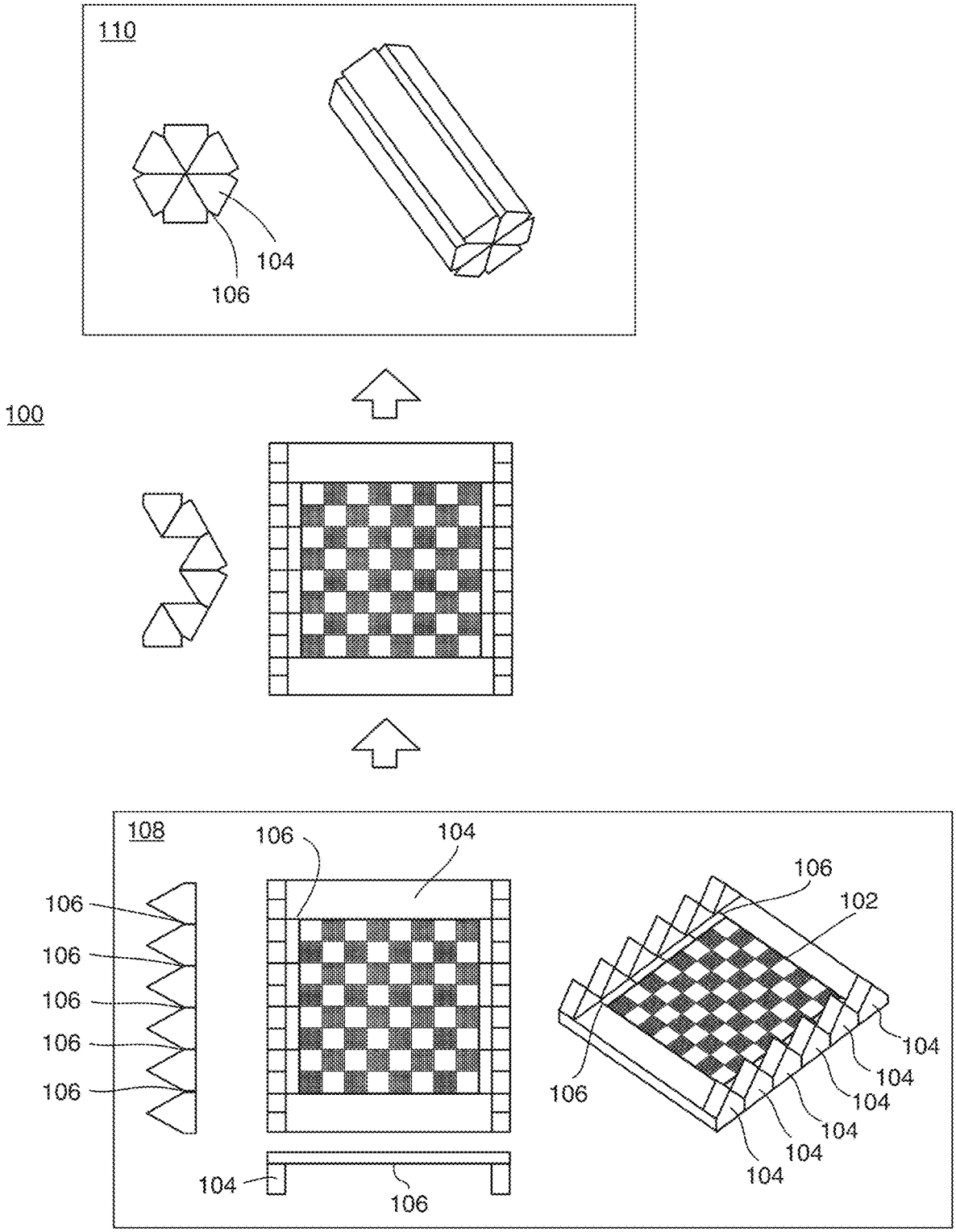
FIG. 1 illustrates an embodiment of the present invention directed to a game board folding into a polygonal prism.

The present invention may be understood more readily by reference to the following detailed description taken in connection with the accompanying figures and examples, which form a part of this disclosure. It is to be understood that this invention is not limited to the specific devices, methods, applications, conditions or parameters described and/or shown herein, and that the terminology used herein is for the purpose of describing particular embodiments by way of example only and is not intended to be limiting of the claimed invention. Also, as used in the specification including the appended claims, the singular forms "a," "an," and "the" include the plural, and reference to a particular numerical value includes at least that particular value, unless the context clearly dictates otherwise. The term "plurality", as used herein, means more than one. When a range of values is expressed, another embodiment includes from the one particular value and/or to the other particular value. Similarly, when values are expressed as approximations, by use of the antecedent "about," it will be understood that the particular value forms another embodiment. All ranges are inclusive and combinable.

It is to be appreciated that certain features of the invention which are, for clarity, described herein in the context of separate embodiments, may also be provided in combination in a single embodiment. Conversely, various features of the invention that are, for brevity, described in the context of a single embodiment, may also be provided separately or in any sub-combination. Further, reference to values stated in ranges include each and every value within that range.

One embodiment of the foldable game board comprises a plurality of elongated base panels where each elongated base panel comprises an inner surface, an outer surface, and a side panel oriented perpendicularly at each end. Each inner surface of the elongated base panels connects edgewise to its adjacent inner surface via a folding mechanism. The folding mechanism allows each of the plurality of elongated panels to fold against an adjacent elongated base panel to form open and closed configurations. The open configuration comprises the plurality of elongated base panels lying coplanar, wherein the plurality of inner surfaces forms and displays a game board capable of holding game pieces in place. The closed configuration comprises the plurality of elongated base panels angled to form a hollow polygonal prism capable of storing game pieces on the enclosed inner surfaces without disrupting their placement.

In some embodiments, the foldable game board comprises four to eight elongated base panels.

In some embodiments, the inner surfaces of the foldable game board comprise a folding mechanism in the form of a hinge, a magnet, or a bendable panel.

In some embodiments, the inner surfaces of the foldable gameboard comprises a folding mechanism in the form of a hinge capable of forming a cross shape in the open configuration and an enclosed cube in the closed configuration. Accordingly, some embodiments can be provided with one or more hinges that are oriented perpendicular, or otherwise non-parallel, to one or more other hinges.

In some embodiments, the ends of the elongated base panels of the foldable gameboard are fastened together by a magnet, a strap, a rope, a string, a button, a clasp, or Velcro to form the close configuration.

In some embodiments, the outer surfaces of the elongated base panels of foldable gameboard are rounded such that, in the closed configuration the plurality of elongated base panels form a cylindrical shape.

Another preferred embodiment of the foldable game board comprises a plurality of elongated base panels where each elongated base panel comprises an inner surface, an outer surface, and a side panel oriented perpendicularly at each end. Each inner surface of the elongated base panels connects edgewise to its adjacent inner surface via a folding mechanism. The folding mechanism allows each of the plurality of elongated panels to fold against an adjacent elongated base panel to form open and closed configurations. The open configuration comprises the plurality of elongated base panels lying coplanar, wherein the plurality of inner surfaces forms and displays a game board capable of holding game pieces in place. The closed configuration comprises the plurality of elongated base panels angled to form a hollow polygonal prism, where each side panels interlocks with an adjacent side panel, capable of storing game pieces on the enclosed inner surfaces without disrupting their placement.

In some embodiments, each side panel of the plurality of elongated base panels of the foldable gameboard are shaped differently.

In some embodiments, the interlocking of each side panel in the closed configuration of the foldable game board is conducted via an interlocking mechanism.

In some embodiments, the interlocking mechanism of the foldable game board comprises a locking panel attached to one end of each side panel of the plurality of elongated base panels.

Another preferred embodiment of the foldable game board comprises a plurality of elongated base panels where each elongated base panel comprises a substantially flat inner surface, an outer surface, and a side panel oriented perpendicularly at each end. Each substantially flat inner surface of the elongated base panels connects edgewise to its adjacent inner surface via a folding mechanism underneath its surface. The folding mechanism allows each of the plurality of elongated panels to fold in one direction against an adjacent elongated base panel to form open and closed configurations. The open configuration comprises the plurality of elongated base panels lying coplanar, wherein the plurality of inner surfaces forms and displays a game board capable of holding game pieces in place. The closed configuration comprises the plurality of elongated base panels angled to form a hollow polygonal prism capable of storing game pieces on the enclosed inner surfaces without disrupting their placement. Wherein the inner surface in the open configuration is kept from extending beyond planar due to the folding mechanism's placement underneath the inner surface.

FIG. 1 (100) shows a folding board game in a user-friendly embodiment. The open configuration (108) displays a game board for playing various games, e.g., Chess. Here, the open configuration (108) is shown from several perspectives. The board is comprised of six elongated base panels (104), although can be comprised of 3, 4, 5, 6, 7, 8, 9, 10, 11, 12, 13, 14, 15, 16, 17, 18, 19, 20, or any natural number greater than 2, which are connected by a folding mechanism (106), e.g., hinges, edgewise such that there are five folding mechanisms (106) and six elongated base panels (104). Together the panels (104) form a flat surface which allows for gameplay. On this surface of this embodiment, the middle four panels house the game board (102), such that each middle panel holds two rows of 8 squares, together forming a full game board for games like chess. Meanwhile, the two most peripheral panels on either end are used for storage of captured pieces. Underneath the surface of each of these panels may be magnetized. Games may be played in this open configuration with pieces placed on either game board or storage areas on end panels. Due to the shape of the panels the board can be picked up and held or even kept in hand during gameplay without upsetting the planar surface.

The folding occurs along the seam between panels on the upper surface of the board (106). This folding, shown in greater detail in FIG. 2, allows the open configuration (108) to fold into the closed configuration (110) in which all elements of the game board and all pieces are contained and protected. The board can be rolled up in this fashion at any point during gameplay without disturbing the positioning of pieces. The board in closed configuration (110) forms a polygonal prism, here a hexagonal shape, approximately the size of a coffee canteen. The outer surface panels of the open configuration (108) of the game board becomes the outer surface of the rolled-up board in the closed configuration (110).

This design and folding are not limited to these dimensions or number of panels. Different board designs that embody the same invention will be shown in later figures.

Figure 2:
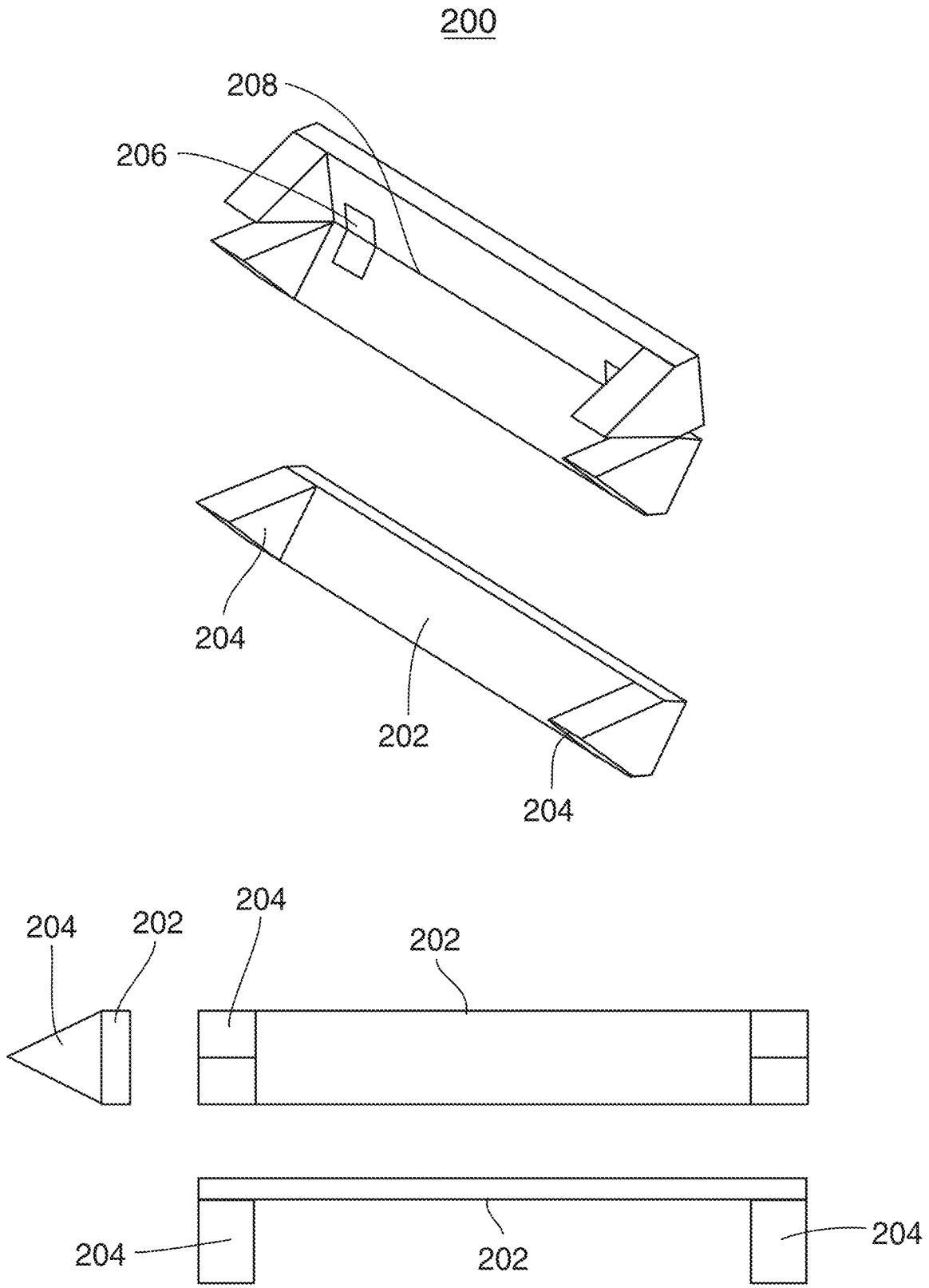
FIG. 2 illustrates an embodiment of the present invention directed to various sections of the elongated base panel.

FIG. 2 (200) demonstrates a single elongated base panel from the embodiment of the board described in FIG. 1, shown from multiple angles. Each panel is comprised of a plank (202), described by flat rectangular prism (of a particular height, width and thickness, here 5/4"×6 7/8"×5/16") with two side panels, or wings (204) on either end of the length of the plank. In this embodiment each side panel (204) is comprised of a triangular prism rising from the plank with the base of the triangle being defined by the width of the plank and the height being defined such that the angle of the top of the wing times the number of panels equals 360 degrees. In this case the triangular prism is 5/8" thick and forms a 60-degree equilateral triangle. In other embodiments the wings of a panel are comprised of triangles of other angles or of non-triangle shapes (see FIGS. 4-6). The folding mechanism, e.g., the hinge, that connects one panel to another (206) lies along the vertex of the panel in which the base of the triangles on each wing meets the length of the plank (208). In other words, the folding mechanism lies edgewise connecting two panels on the inner surface of the board (208). Folding mechanisms occur on both sides of the panel for central panels and only on one side for peripheral panels (see FIG. 1). The number of panels needed is defined by the angle of rotation allowed to each hinge. In this case the side panels form a 30-degree angle from vertical on each side, meaning that 60 degrees of rotation is permitted at each hinge, so six panels are needed to complete an enclosed solid (as in FIG. 1).

Figure 3:
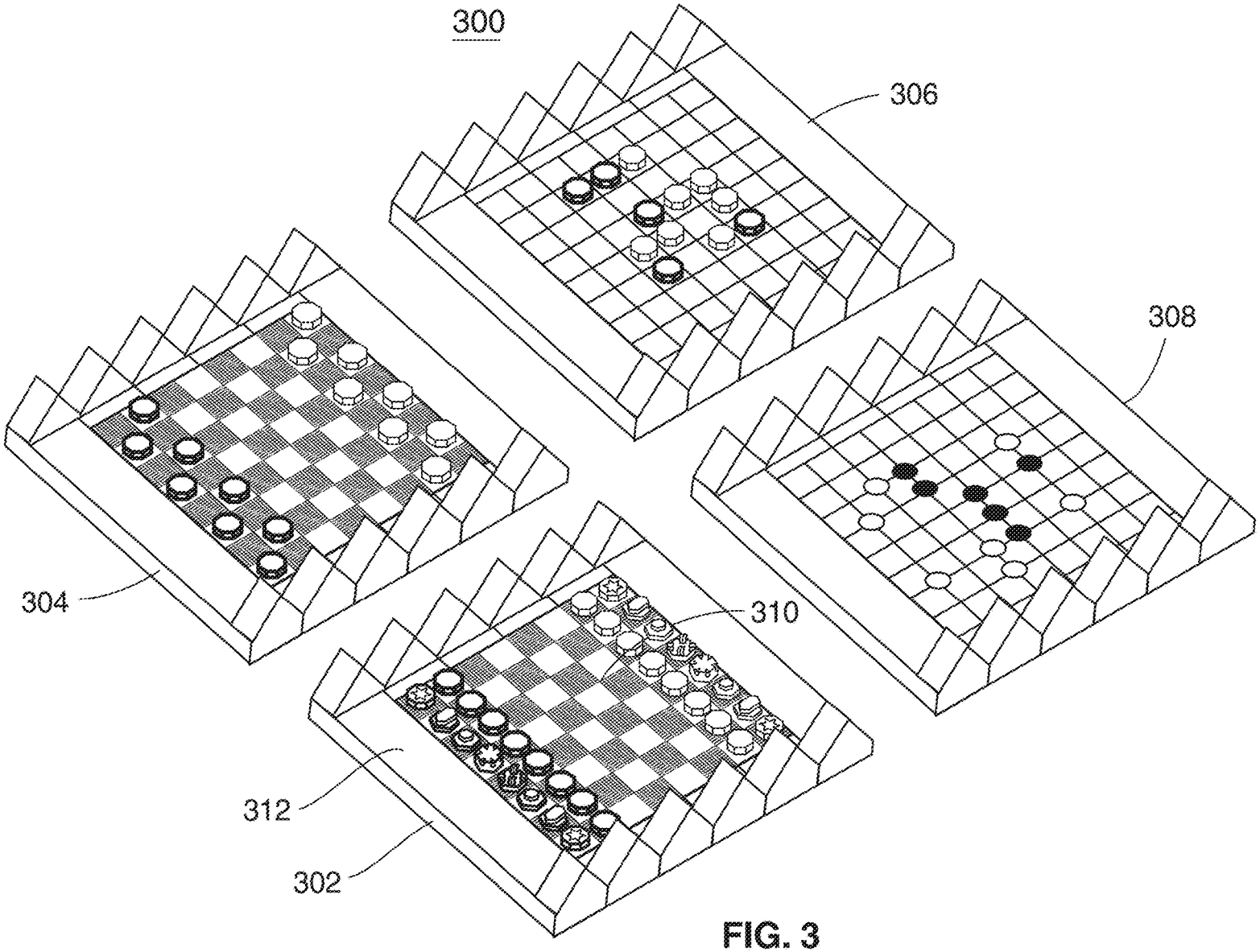
FIG. 3 illustrates an embodiment of the present invention directed to displaying various board games on the inner surfaces of the foldable game board.

While FIG. 1 showed a chess board, a range of board games could be played using this device. In FIG. 3 (300), the hexagonal embodiment is adapted to play chess (302), checkers (304), Othello (306) and Go (308). This is by no means an exhaustive list of board games that this invention can be adapted to contain. This invention can house virtually any board game whose spatially relevant components of gameplay can be magnetized. For each of these embodiments, a game board is housed on central panels (310), while storage space for extra or captured pieces exists on the terminal panels (312). Notably, in the case of go (308), the game board is shifted relative to the panel-space because pieces are placed on vertices rather than squares and centering the board on the sideline of the panel-space would force pieces to be played on a junction between two panels. This could result in shifting pieces when the board is opened and closed, a problem avoided, by shifting the game board slightly.

Figure 4:
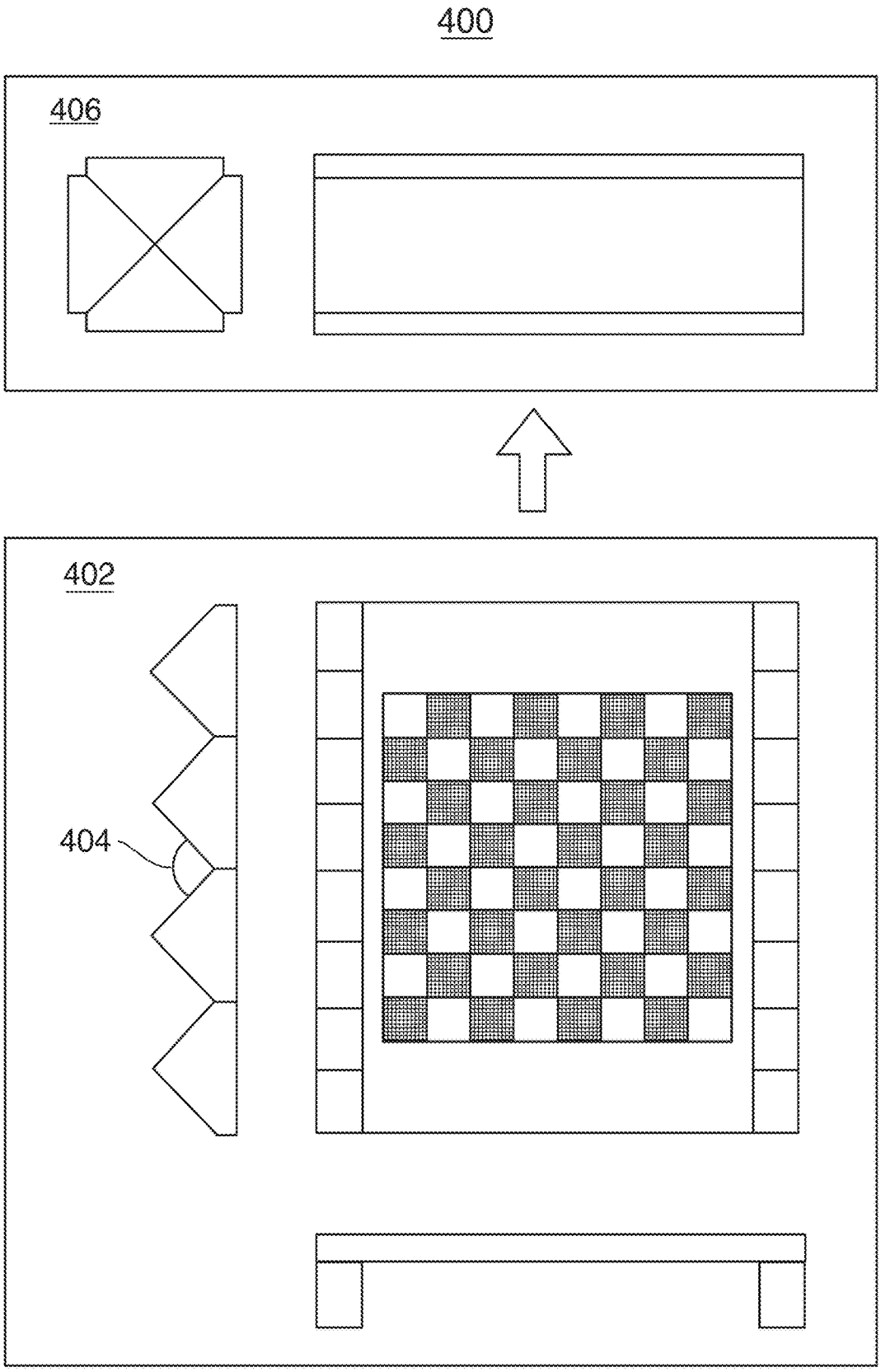
FIG. 4 illustrates an embodiment of the present invention directed to a foldable game board with exactly four elongated base panels.
Figure 5:
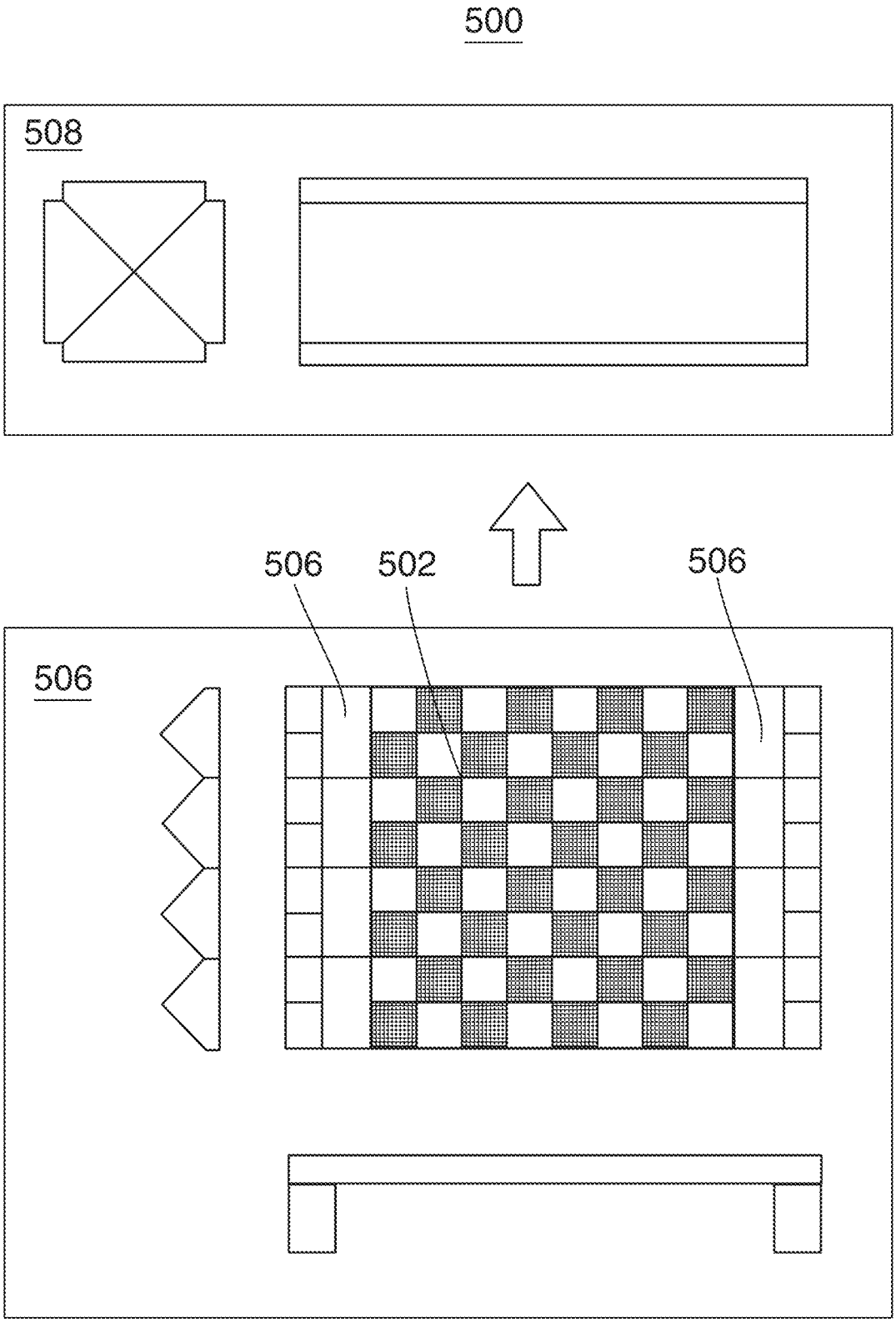
FIG. 5 illustrates an embodiment of the present invention directed to an extended foldable game board with exactly four elongated base panels.

In FIG. 4, an embodiment of the invention is shown that uses four elongated base panels. The open configuration is shown on the left from several perspectives (402). Here, the angle between adjacent side panels (404) is 90 degrees, and thus permits 90 degrees of flexion from the open board configuration. This allows an enclosed board to be achieved in the closed configuration (406) with only four elongated base panels (360 degrees divided by 90 degrees). Other embodiments could use a range of different angles and panel numbers.

Where prior figures showed embodiments with storage on the terminal panels, the embodiment provided in FIG. 5 (500) shows that the length of each elongated base panel can be extended to provide further storage (502) on either side of the game board (504). In this particular embodiment (506 in open configuration, 508 in closed configuration) a game board (502) of the same size as in FIGS. 1 and 4, is distributed between four panels that each have side panels at 45 degrees from vertical, and thus form a four-piece enclosed board.

Figure 6:
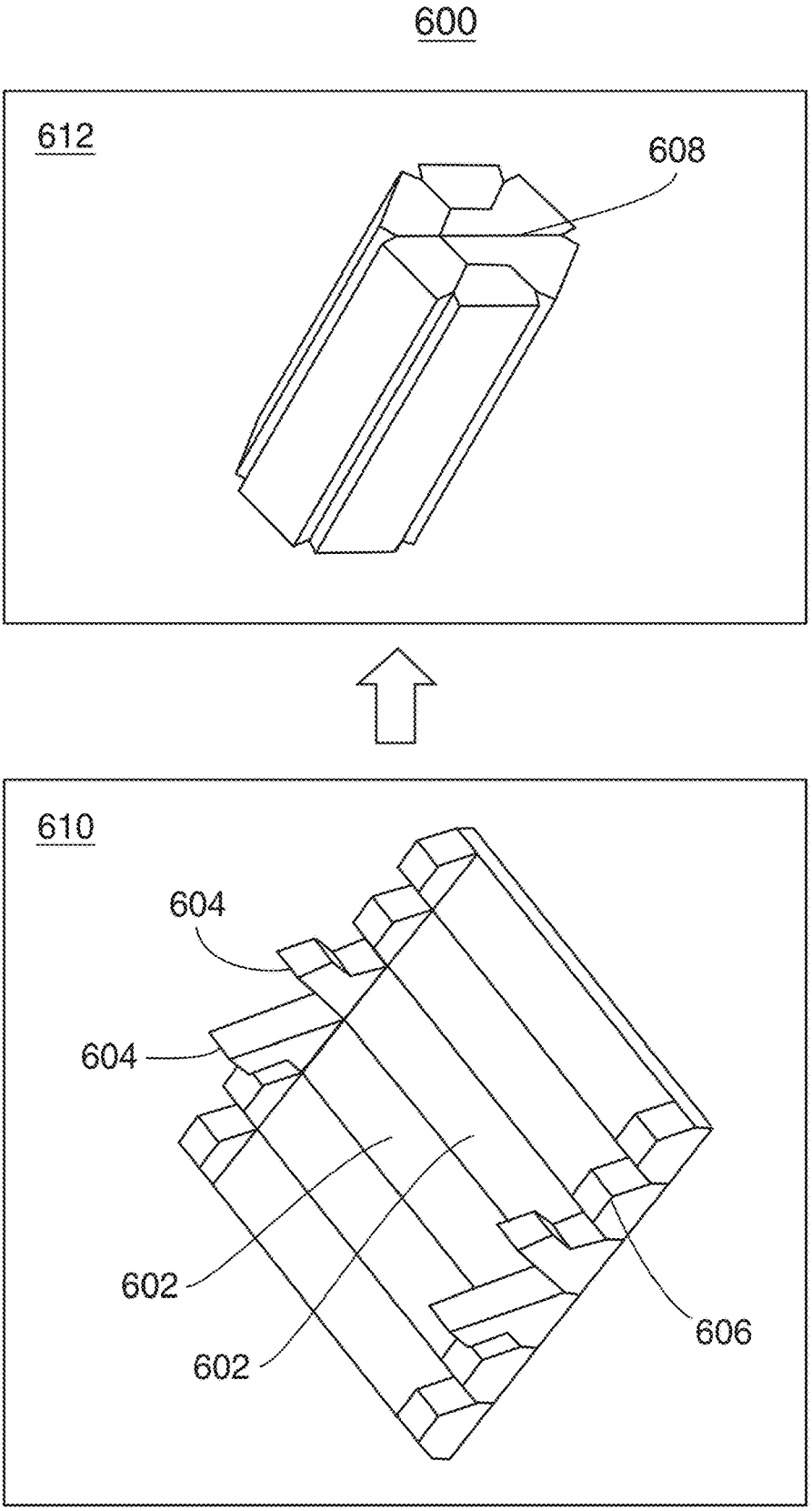
FIG. 6 illustrates an embodiment of the present invention directed to a foldable gameboard with asymmetrical side panels.

The side panels of each panel can vary, and uniformity is not needed to make a functional product or to embody this invention. In FIG. 6 (600), the two center panels (602) have larger side panels (604), encompassing material that would in FIG. 1 be distributed equally among the side panels. In this case, the other four elongated base panels (606) contain smaller side panels with the total cross-sectional area being ultimately equal to that of FIG. 100 and thus forming a closed surface (608) when the board rolls from open (610) to closed (612) configurations. This particular embodiment allows for smoother sequential closing of the panels. Another viable embodiment would be if every side panel was blunted as in 606. This would leave a hole in the middle from external to internal surface, which depending on the application might be warranted.

Figure 7:
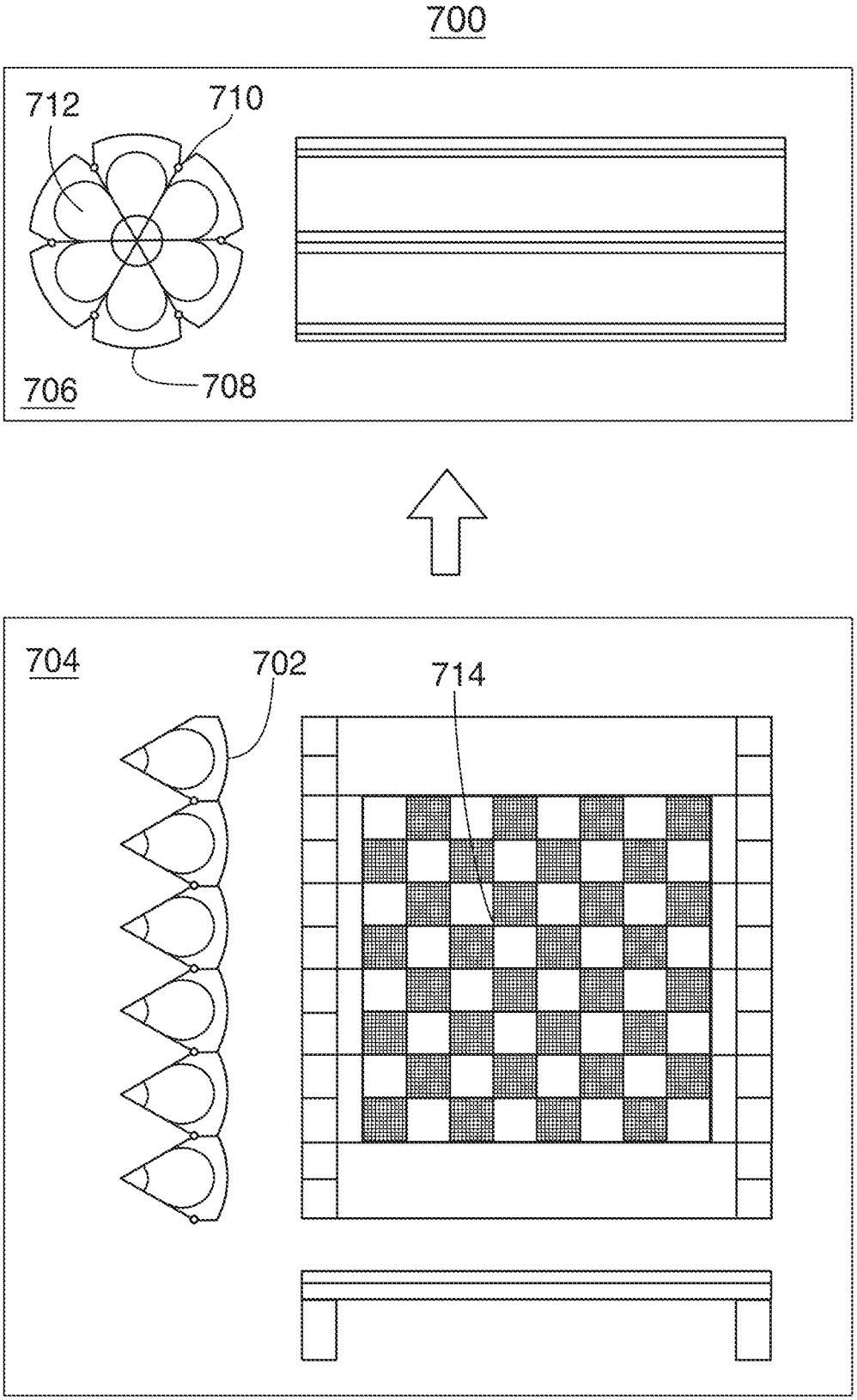
FIG. 7 illustrates an embodiment of the present invention directed to a game board with rounded outer surface panels folding into a cylindrical shape with art on the side panels.

FIG. 7 shows an embodiment (700) in which the outer surface of each elongated base panel (702) is rounded such that when the product rolls from open (704) to closed (706) configuration, the resulting solid forms a cylindrical shape whose cross-section's perimeter lies mainly on a circle (708). The cross section deviates from a perfect circle only in places where notches (710) must occur for folding from closed (706) to open (704) configuration. This does not affect the surface of the panel bordering the folding mechanism, and thus the angles of folding remain 60 degrees, identical to the embodiment in FIG. 1. The rounded bottom surfaces (702) will not prevent the board from sitting flat on normal surfaces, because gravity will keep each panel open at full extension.

FIG. 7 also demonstrates how panels can be decorated such that the outside of the board can be covered any branding or decoration desired, such as a flower in this case (712). The game board (714) is entirely enclosed, allowing the product to be decorated to fit any number of styles or appearances not necessarily related to chess or whatever game is contained.

Figure 8:
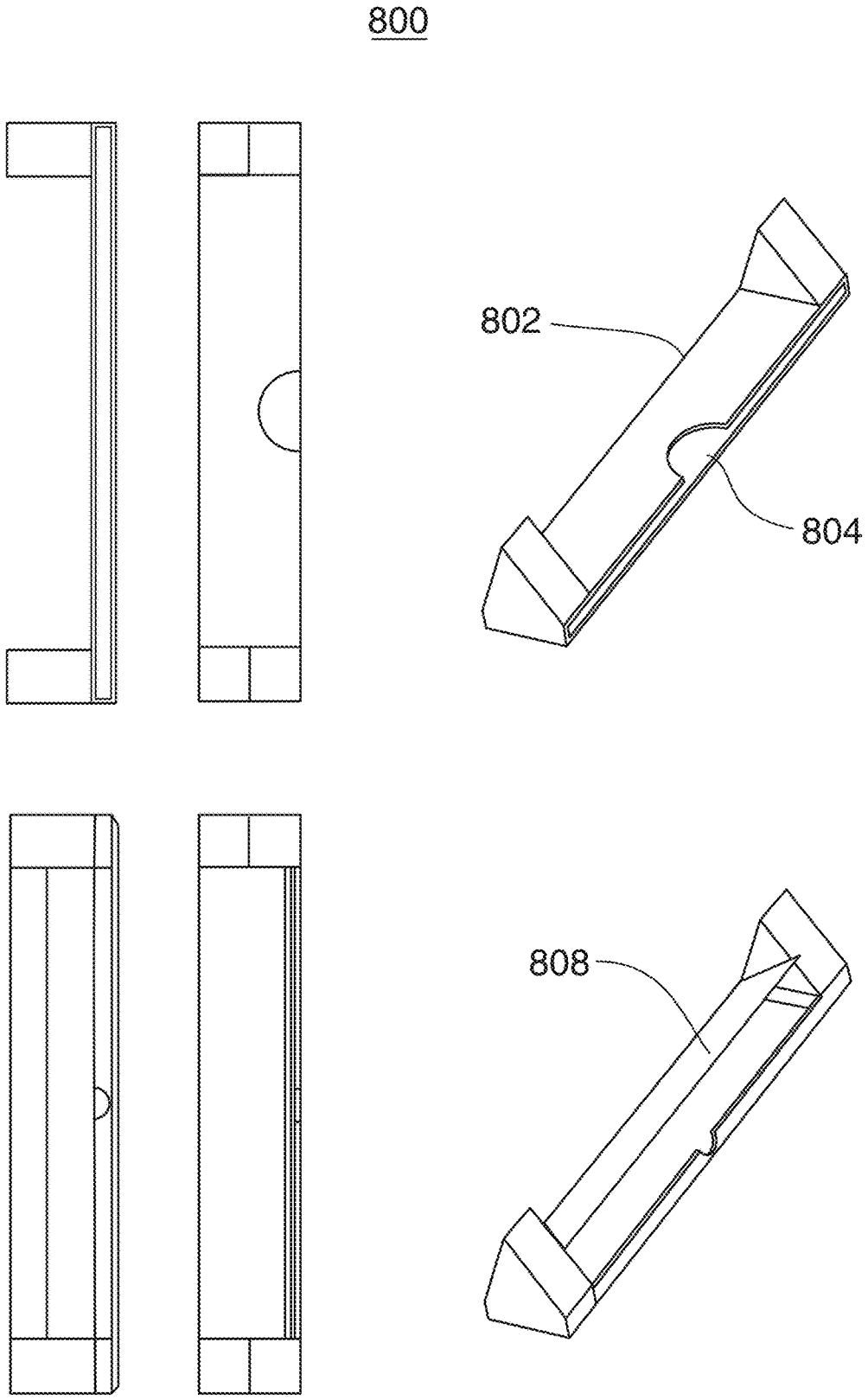
FIG. 8 illustrates an embodiment of the present invention directed to a foldable game board with storage underneath the inner surface panels.

In some embodiments the elongated base panels can be used to store pieces or other items (though this is not necessary for embodiments of chess and other games where pieces can be stored on the surface of panels). This is demonstrated in FIG. 8 (800) with several perspectives on a panel in which the plank portion (802) is hollow and one wall is open to form a storage slot (804). This slot could be used to store alternative patterns for game boards (e.g., switching between chess and go). In 806, three views are provided on an alternative panel design which is similarly hollow but for which the top portion of the plank is hinged to form a lid (808). Pieces could be stored within.

Figure 9:
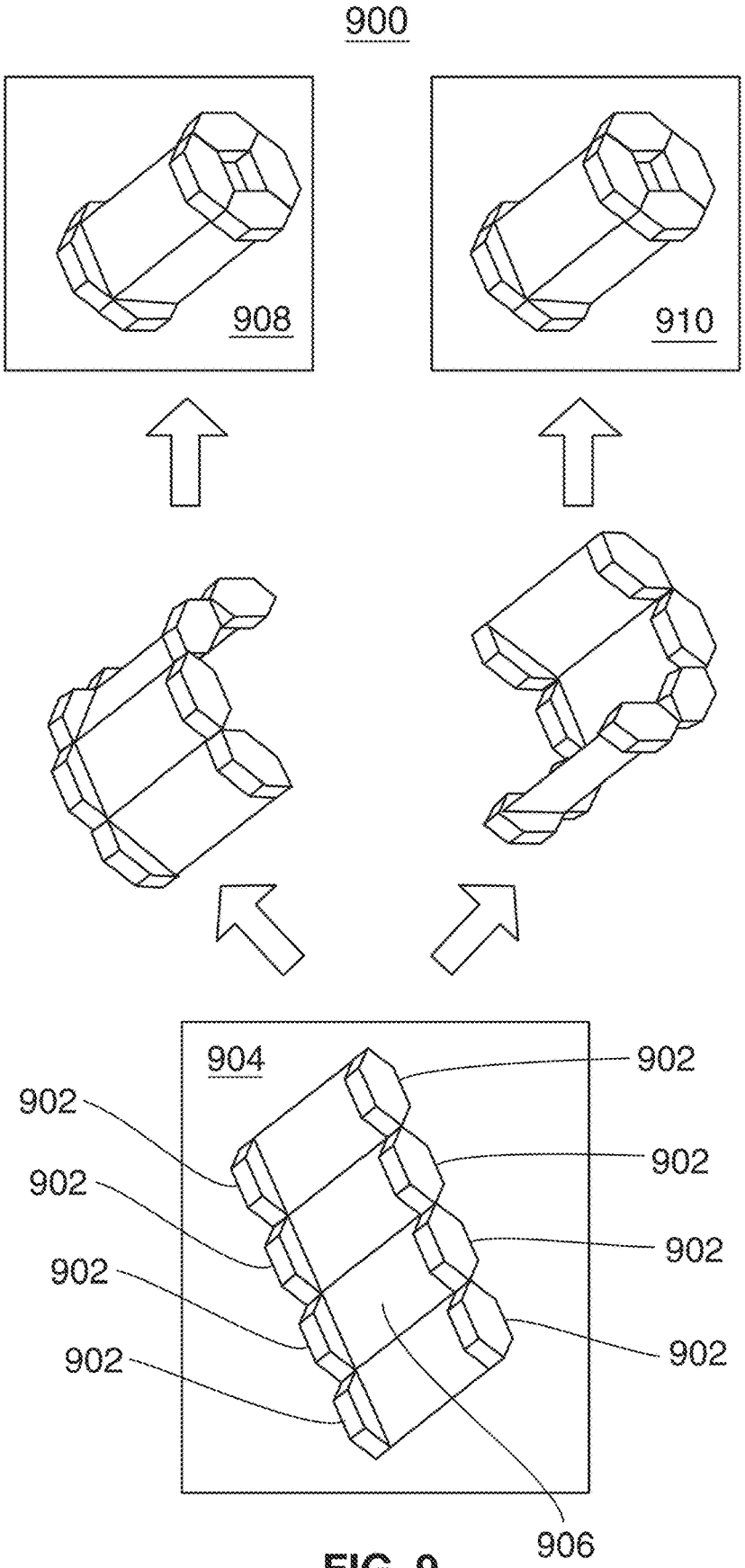
FIG. 9 illustrates an embodiment of the present invention directed to a foldable game board capable of folding in multiple orientations.

Referring to FIG. 9, the invention can be embodied as a solid (900) with side panels (902) on both inner and outer surface panels as opposed to just the inner surface as shown in prior figures. Here, a four-elongated base panel embodiment can form two flat surfaces when the board is in open configuration (904), an orange surface on the top (906) and a blue one on the reverse side. The board can then be folded in either direction into one of two closed configurations, one predominantly orange with concealed blue surfaces (908) and one predominantly blue with concealed orange surfaces (910).

Figure 10:
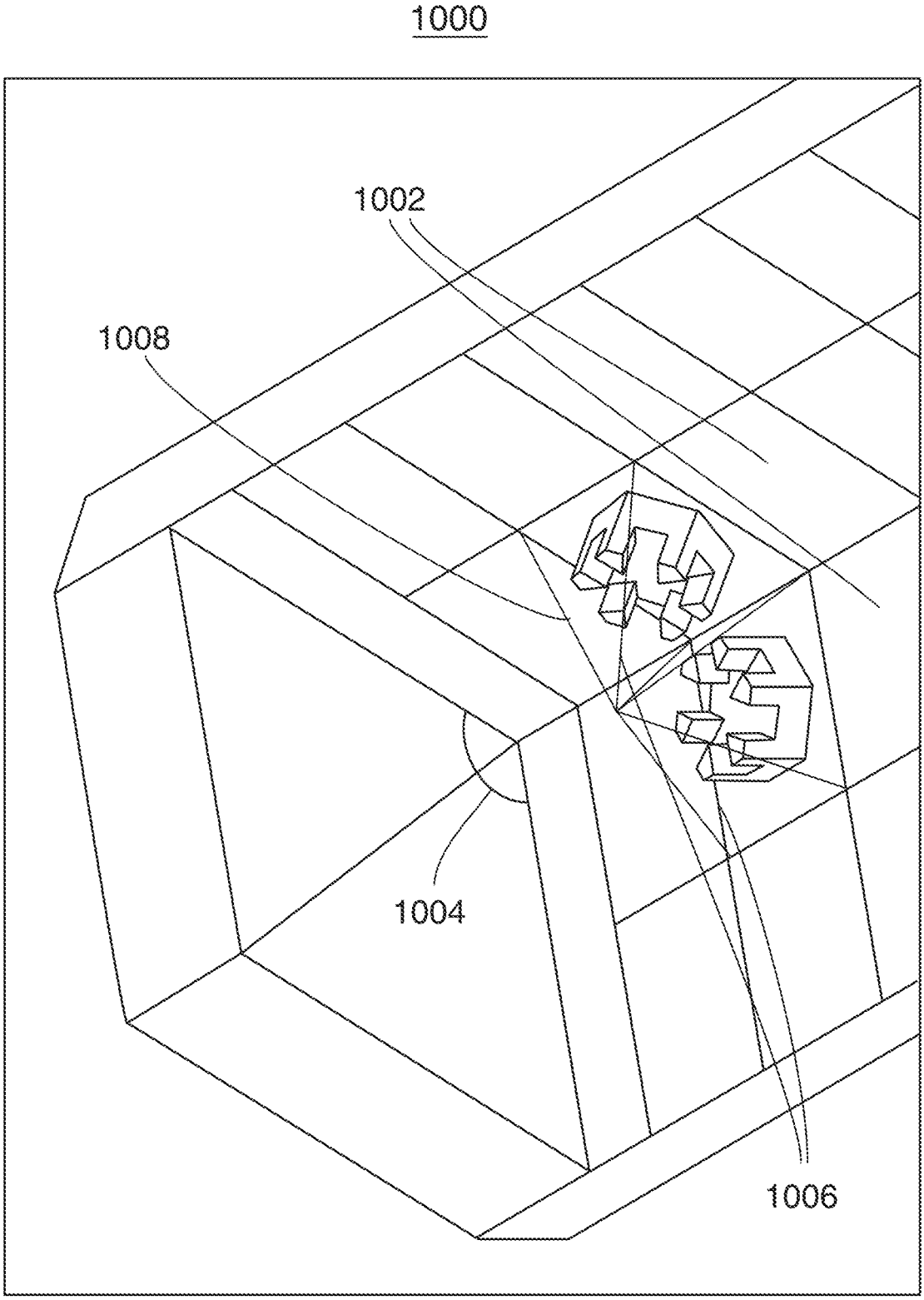
FIG. 10 illustrates an embodiment of the present invention directed to restrictions of game pieces inside a foldable game board.

FIG. 10 demonstrates how the invention accommodates three-dimensional game pieces when it is in closed configuration. Game board tiles on adjacent panels (1002) are coplanar when the board is open, but at an angle to each other when the board is rolled into closed configuration. This angle (1004) is determined by the number of panels in the whole (360 degrees divided by the panel number, which is in this case of the hexagonal embodiment, 60 degrees). Game pieces that might be placed on adjacent squares of different panels (1006) would be rotated towards each other when the board is in closed configuration. To avoid contact and shifting of pieces during play, the pieces must be small enough to be contained in a rectangular pyramid (1008) with the base defined by a game square and faces at angle x (1004) from the base, where x (1004) is the angle between the edge of the side panel and the inner surface panel, in this case 60 degrees.

Figure 11:
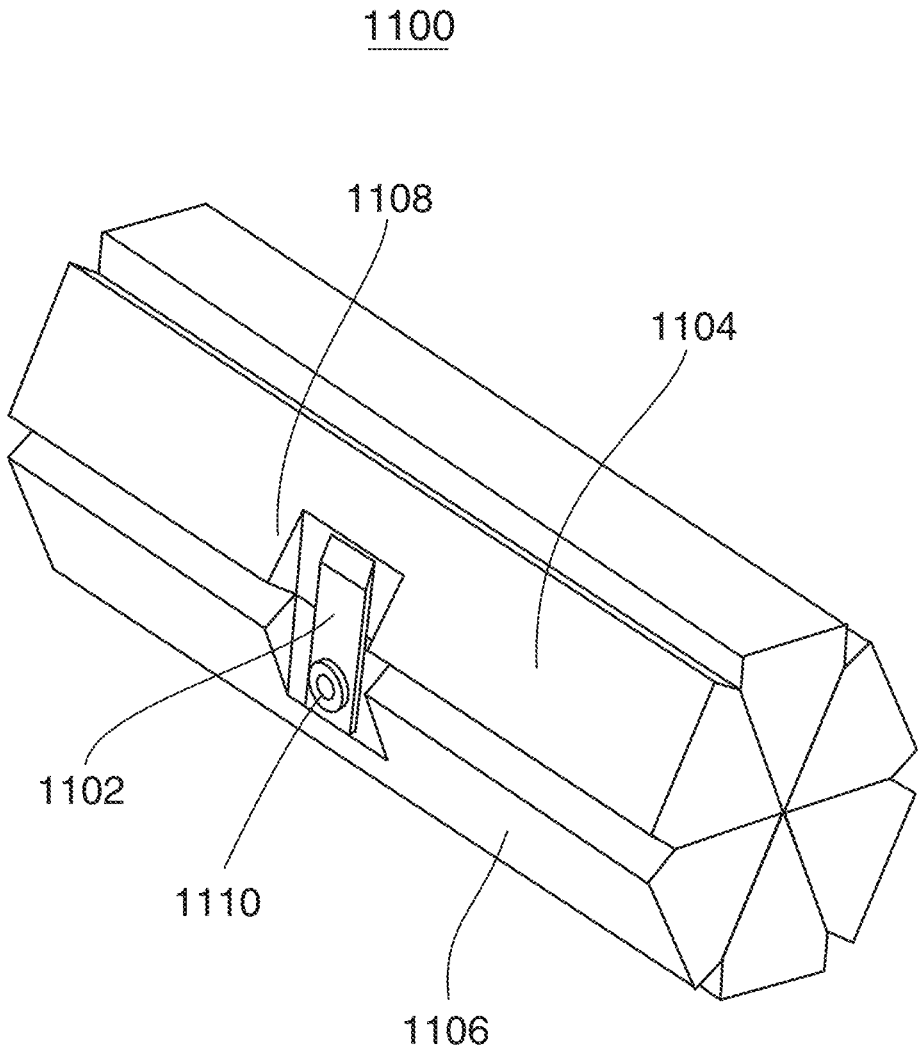
FIG. 11 illustrates an embodiment of the present invention directed to a fastening mechanism that keeps a foldable game board in the closed configuration.

Referring to FIG. 11, the board in closed configuration can be held in this configuration through the use of a fastening mechanism, e.g., a strap, (1102) spanning from one terminal outer surface panel (1104) to the other (1106). Here this is shown with the two terminal panels each having a wedge removed (1108) from the external portion of the plank of each to create a shared plane between the two when the board is rolled up. A strap or other fastening mechanism (1102) can be fixed to one panel and fastened (1110) to the other to allow for convenient locking of the structure in this closed configuration.

Figure 12:
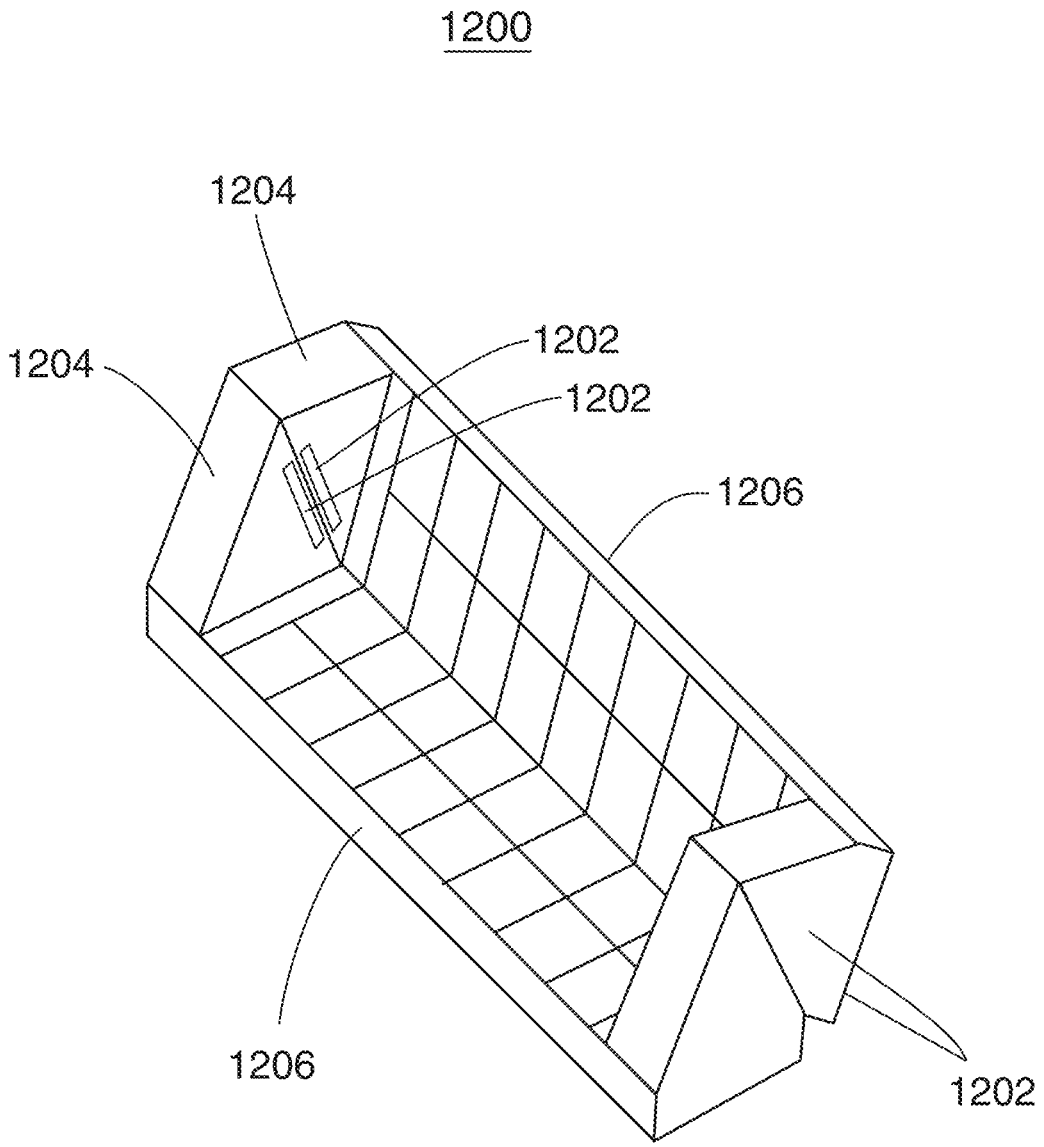
FIG. 12 illustrates an embodiment of the present invention directed to another fastening mechanism that keeps a foldable game board in the closed configuration.

FIG. 12 demonstrates a second method by which the board can be fastened in its closed configuration. Here magnets (1202) can be placed in the wings (1204) of each terminal panel (1206). For clarity and visibility, these are the only two panels shown in this image. Each magnet (1202) is placed in the side panel (1204) such that it is close enough to the other terminal panel's magnet to be attracted to it. This allows for an alternative method of conveniently sealing the board in closed configuration.

Figure 13:
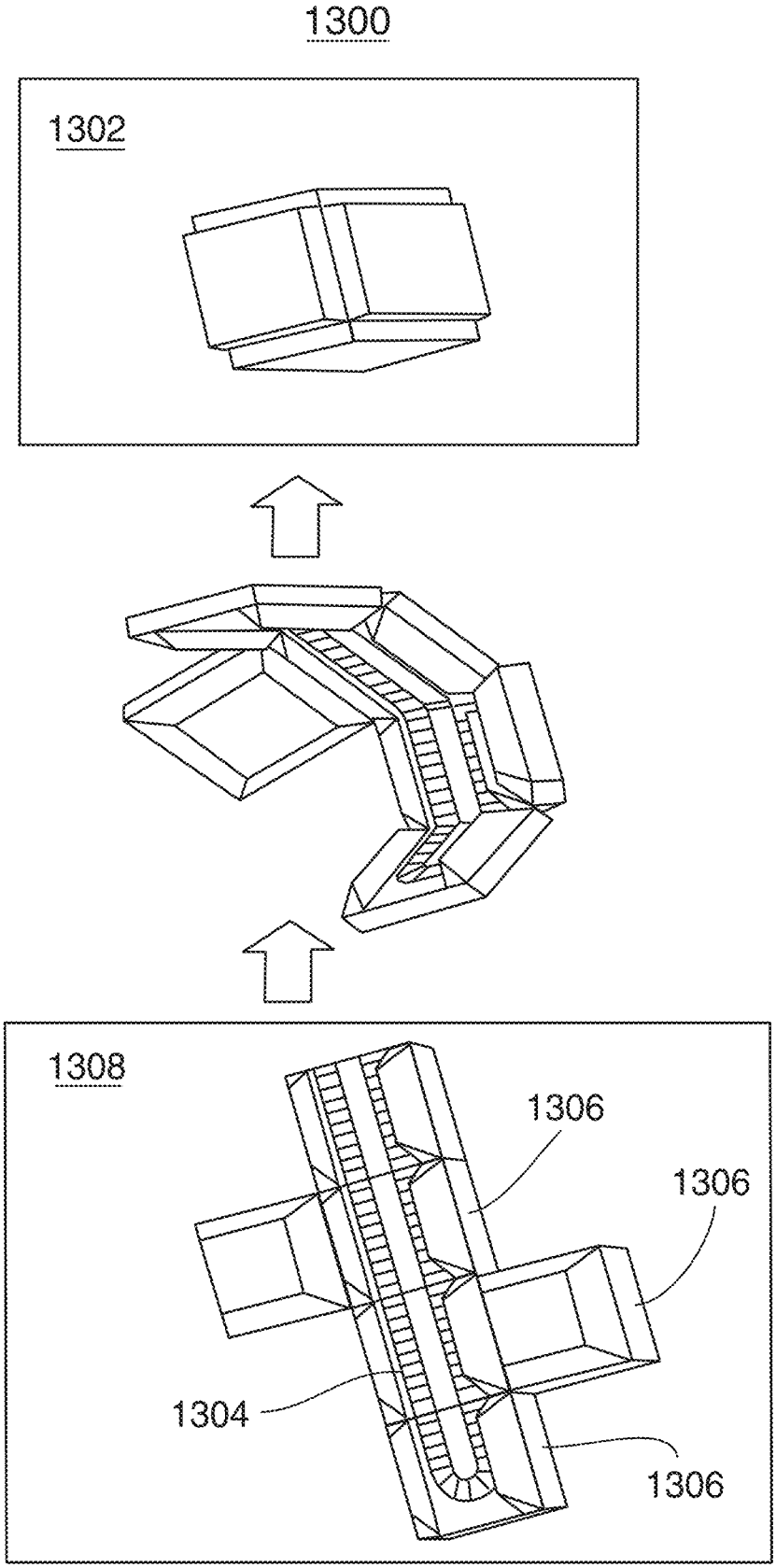
FIG. 13 illustrates an embodiment of the present invention directed to a foldable game board capable of folding in three dimensions.

Referring to FIG. 13, an embodiment of the invention can be made in which the base panels are folded in multiple dimensions such that panels can fold to enclose a cube (1302). Here an embodiment shows how a cribbage board (1304) can be housed in this way. This embodiment is also suitable for housing children's toys and tools. The fundamental folding mechanism is the same as in models above. Namely the panels (1306) are attached edgewise by a folding mechanism, e.g., a hinge, in order to form a flat surface in one extreme of rotation (1308) while forming a hollow solid in the other extreme (1302), in which the game board (1304), or more generally the outer surface of the board when lying flat, is entirely concealed.

Figure 14:
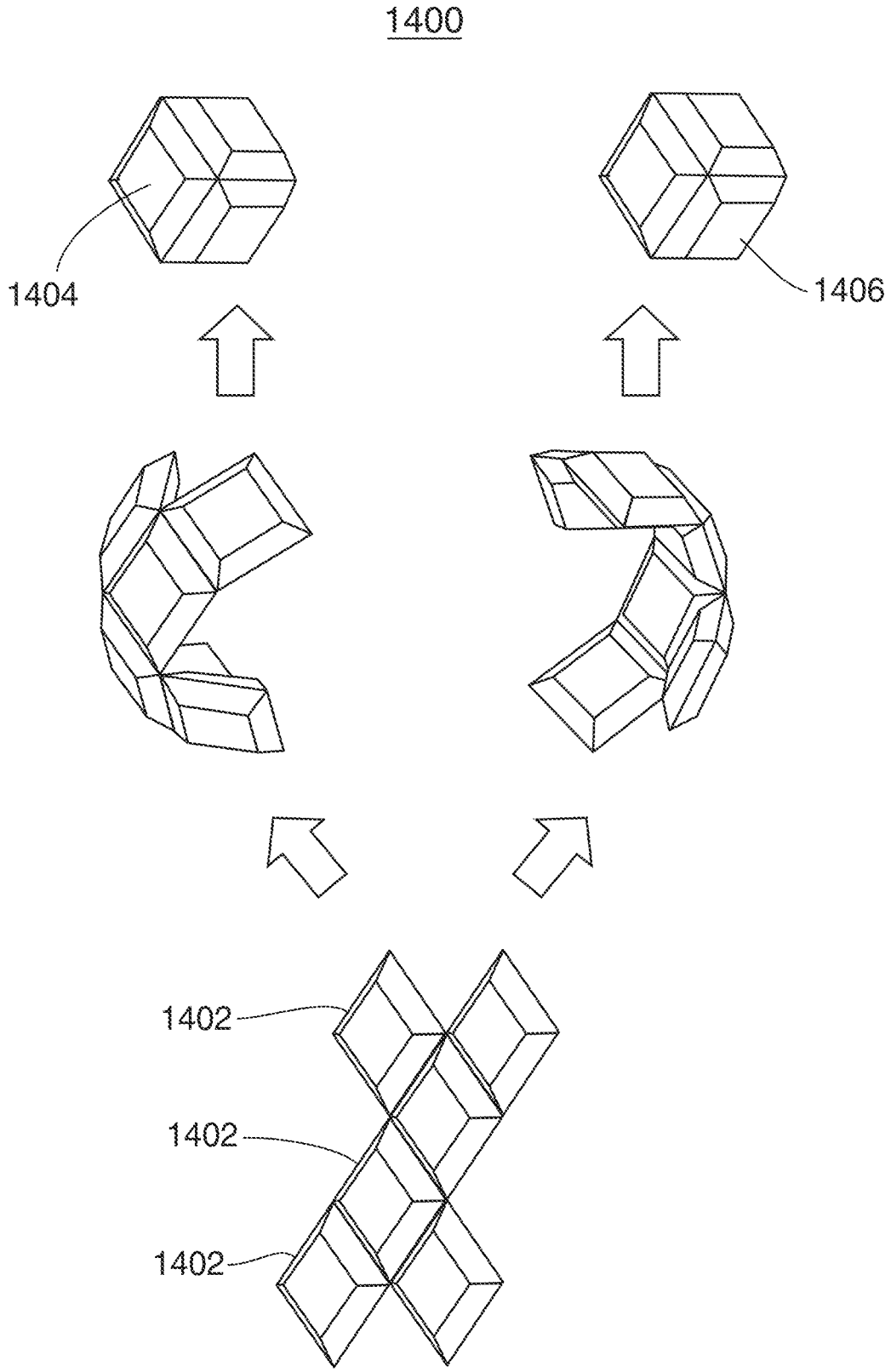
FIG. 14 illustrates an embodiment of the present invention directed to a foldable game board capable of folding into multiple cubes depending on the direction of the three-dimensional fold.

Referring to FIG. 14, the invention can be embodied to incorporate features of both FIGS. 12 and 13, such that a flat surface can fold in both directions and on multiple axes. Here, 1400, the open configuration of an object is comprised of 6 base panels (1402) which are beveled on both sides to allow folding in either direction and which can be folded on four sides to allow three dimensional folding. Depending on the direction of folding, one of two cubes is formed. In this case, one configuration has light gray faces visible with all dark gray faces concealed (1404), while the other has dark gray faces visible with light gray faces concealed (1406).

Figure 15:
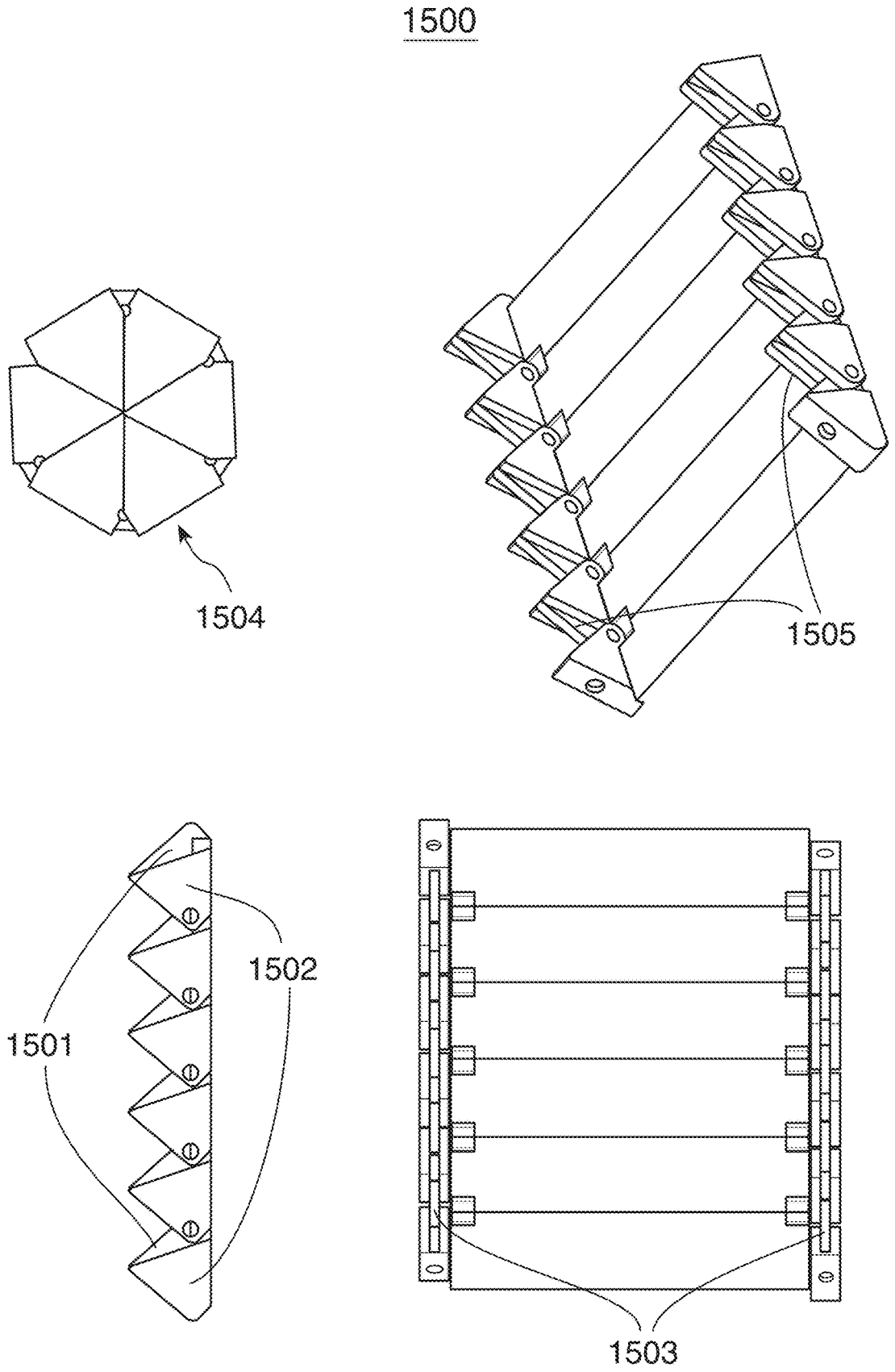
FIG. 15 illustrates an embodiment of the present invention directed to a foldable game board with interlocking side panels.

Referring to FIG. 15, an embodiment of the invention from any previous figure can be made to strengthen the closed configuration (1504) by incorporating a side panel of different shapes capable of interlocking with adjacent side panels. A view from the side of the foldable game board shows the side panels (1502) with an interlocking mechanism (1501). Various other viewpoints show the interlocking mechanism (1503) and (1505) and its corresponding side panels. The closed configuration (1504) is formed when each side panel interlocks with its adjacent side panels, thereby strengthening the integrity of the close configuration (1504). For example, one embodiment of a suitable interlocking mechanism (1501) can be a tongue and groove construction formed on the edges of the side panel, whereby in the closed configuration, the tongue edge of each side panel fits into the groove edge of each adjacent side panel. Another embodiment of a suitable interlocking mechanism (1501) can be in the form of a locking panel.

The disclosures of each patent, patent application, and publication cited or described in this document are hereby incorporated herein by reference, in its entirety.

Those skilled in the art will appreciate that numerous changes and modifications can be made to the preferred embodiments of the invention and that such changes and modifications can be made without departing from the spirit of the invention. It is, therefore, intended that the appended claims cover all such equivalent variations as fall within the true spirit and scope of the invention.

CLAUSES

Clause 1. A foldable game board comprising: a series of members each of which has a flat surface capable housing parts of the game board as well as protrusions from said surface on either end of the length of each member, each of which forms a triangular prism with triangle faces pointing along the length of the member; a series of hinges connecting said members along the axis of the edges of each member in which the upper surface (i.e. gameplay side) meet each side surface, such that the all hinge axes are parallel; a folding mechanism whereby each said member can hinge against its neighboring members by said hinges to move between open and closed configurations, wherein open configuration allows for gameplay and closed configuration creates a hollow and enclosed or semi-enclosed compartment containing all game squares and pieces; wherein the folding to closed configuration is defined by the barrier to further folding created by contact between said protrusions; space for the storage of pieces on surface of said members that lies within said compartment during closed configuration but lies outside of the game squares; a chess board distributed among the said members with magnetic plates underneath game squares for the purpose of holding pieces in place.

Clause 2. A foldable board in accordance with clause 1 wherein the angle at the vertex of each protrusion is 60 degrees and the number of members is 6, such that in closed configuration the vertices of all protrusions meet such that the protrusions form a closed surface on either length of the board.

Clause 3. A foldable board in accordance with clause 1 wherein the angle at the vertex of each protrusion is 90 degrees and the number of members is 4, such that in closed configuration the vertices of all protrusions meet such that the protrusions form a closed surface on either length of the board.

Clause 4. A foldable board in accordance with clause 1 wherein the length of each member is extended to accommodate the storage of pieces on either side of the gameplay area.

Clause 5. A foldable board in accordance with clause 1 wherein shapes other than triangular prisms form the protrusions (including but not limited to a trapezoidal prism).

Clause 6. A foldable board in accordance with clause 1 wherein the said protrusions are of shape or set of shapes that do not form a completely continuous surface and thus do not fully enclose the interior compartment when the board is in closed configuration.

Clause 7. A foldable board in accordance with clause 1 which does not use magnetic panels under the gameplay area.

Clause 8. A foldable board in accordance with clause 1 wherein checkers are housed instead of chess.

Clause 9. A foldable board in accordance with clause 1 wherein other board games are housed instead of chess (parcheesi, go, backgammon etc.).

Clause 10. A foldable board in accordance with clause 1 wherein the board is used to house Children's toys rather than a rule-based board game.

Clause 11. A foldable board in accordance with clause 1 wherein said member have curved rather than flat surfaces.

Clause 12. A foldable board in accordance with clause 1 wherein each said member is roughly the shape of a rectangular prism.

Clause 13. A foldable board in accordance with clause 1 wherein members are connected by magnets rather than hinges.

Clause 14. A foldable board in accordance with clause 1 wherein members are connected by elastic cord running between members instead of hinges.

Clause 15. A foldable board in accordance with clause 1 wherein the board is made out of wood.

Clause 16. A foldable board in accordance with clause 1 wherein the board is fastened in closed configuration with magnets.

Clause 17. A foldable board in accordance with clause 1 wherein the board is fastened in closed configuration with a latch, snap button or other fastening means.

Clause 18. A foldable board in accordance with clause 1 wherein the board is produced using a 3D printer.

Clause 19. A foldable board in accordance with clause 1 wherein members are transparent.

Clause 20. A foldable board in accordance with clause 1 wherein the exterior of the board when in closed configuration is decorated with images.

Clause 21. A foldable board in accordance with clause 1 wherein the exterior of the board when in closed configuration is decorated such that each protrusion has a flower petal that creates a the image of flower when in closed configuration.

Clause 22. A foldable board in accordance with clause 1 wherein the bottom of each said member is rounded such that, when in closed configuration, the board approximates a cylinder rather than a polygon-based prism.

Clause 23. A foldable board in accordance with clause 1 wherein some or all of the members contain within themselves compartments for storing game pieces.

Clause 24. A foldable board in accordance with clause 1 wherein chess pieces are designed to fit within the virtual pyramid whose base is a single game square and whose vertex is defined such that two pyramids arising from two adjacent squares on adjacent said members would not overlap when he board is in closed configuration, whereby the angle of the face of the pyramid from the game square is the same as the angle of the triangle of the protrusion from the gameplay board.

Clause 25. A foldable game board comprising: a series of members each of which is roughly the shape of a rectangular prism and has a flat surface capable housing parts of the game board as well as protrusions from said surface on either end of the length of each member, each of which forms a triangular prism with triangle faces pointing along the length of the member; a series of hinges connecting said members along the axis of the edges of each member in which the upper surface (i.e. gameplay side) meets each side surface, such that the all hinge axes are parallel; a folding mechanism whereby each said member can hinge against its neighboring members by said hinges to move between open and closed configurations, wherein open configuration allows for gameplay and closed configuration creates a hollow and enclosed or semi-enclosed compartment containing all game squares and pieces; wherein the folding to closed configuration is defined by the barrier to further folding created by contact between said protrusions; space for the storage of pieces on surface of said members that lies within said compartment during closed configuration but lies outside of the game squares; a chess board distributed among the said members with magnetic plates underneath the game squares for the purpose of holding pieces in place.

Clause 26. A foldable game board comprising: a series of rigid members each of which is roughly the shape of a flat rectangle with two flat surfaces, one on each side, as well as protrusions from both of said surfaces on either end of the length of each member, thus forming four protrusions per member; wherein each said protrusion forms a triangular prism with triangle face pointing along the length of the member; a series of hinges connecting said members along the axis of the length of each member, such that the all hinge axes are parallel; a folding mechanism whereby each said member can hinge against its neighboring members by said hinges to move between open and closed configurations, wherein open configuration allows for gameplay on either flat surface and wherein there are two closed configurations at either extreme of flexion of said hinges, wherein each closed configuration creates a hollow and enclosed or semi-enclosed compartment; wherein the folding to either closed configuration is defined by the barrier to further folding created by contact between said protrusions.

Clause 27. A foldable game board comprising: a series of rigid members each of which is roughly the shape of a rectangular prism, in which the largest face is a square, present on both upper and lower faces; wherein each said member contains a protrusion on its upper face whose borders are shared with a virtual square pyramid defined by said square face of each member with height equal to half the length of said square; a series of hinges connecting said members to adjacent members with hinges lying on axes defined by the perimeter of said upper face wherever said members meet; a folding mechanism whereby each said member can hinge against its neighboring members by said hinges to move between open and closed configurations, wherein open configuration entails all said upper surfaces lying coplanar and wherein closed configuration entails each said upper surface lying at 90 degrees to upper surfaces of adjacent members; wherein the closed configuration above forms a three-dimensional cube made up of said members; wherein extension beyond open configuration is stopped by the smaller faces of said members which define the thickness or short axis of said member, and which are in contact during open configuration.

Clause 28. A foldable game board comprising: a series of rigid members each of which is roughly the shape of a rectangular prism, in which the largest face is a square, present on both upper and lower faces; a series of hinges connecting said members to adjacent members with hinges lying on axes defined by the perimeter of said upper face wherever said members meet; a folding mechanism whereby each said member can hinge against its neighboring members by said hinges to move between open and closed configurations, wherein open configuration entails all said upper surfaces lying coplanar and wherein closed configuration entails each said upper surface lying at 90 degrees to upper surfaces of adjacent members; wherein the closed configuration above forms a three-dimensional cube made up of said members; wherein extension beyond open configuration is stopped by the smaller faces of said members which define the thickness or short axis of said member, and which are in contact during open configuration; wherein flexion beyond closed configuration at any given hinge is stopped by protrusions on the upper surface of each said member, such that the faces of said protrusions come into contact at the angle of flexion desired for closed configuration.

Clause 29. A foldable board in accordance with clause 28 wherein the board houses a cribbage gameplay and compartment to hold playing cards.

Clause 30. A foldable board in accordance with clause 28 wherein said members are hinged in more than one dimension such that they form a cross shape when in open configuration and a fully enclosed cube in closed configuration.

Clause 31. A foldable board in accordance with clause 28 wherein said protrusions are of different shapes on different said members.

Clause 32. A foldable board in accordance with clause 28 wherein members are of different shapes than square.

Clause 33. A foldable object comprising: a series of rigid members each of which is roughly the shape of a flat square with two flat surfaces; a series of hinges connecting said members along hinge axes defined by the perimeter of said square where any two members share an edge; a folding mechanism whereby each said member can hinge against its neighboring members by said hinges to move between open and closed configurations, wherein open configuration entails all said members lying coplanar and wherein there are two closed configurations at either extreme of flexion of said hinges, wherein each closed configuration is defined by 90 degree angles at each said hinge and creates a cube formed by said members; wherein flexion beyond closed configuration at any given hinge is stopped by protrusions on the surface of each said member, such that the faces of said protrusions come into contact at the angle of flexion desired for closed configuration; wherein the interior surface of one cube at one closed configuration becomes the exterior surface of the other cube at the other closed configuration.

Clause 34. A object in accordance with clause 33 wherein, said cubes formed by each closed configurations are different colors.

Clause 35. A foldable object comprising: a series of members each of which is a rigid geometric shape; a series of hinges connecting said members to form a connected whole between all members; whereby said members together create a grossly flat surface comprised of surfaces from members which are grossly coplanar; a folding mechanism wherein said members fold along said hinges between open configuration, in which members from said grossly flat surface, and closed configuration in which members form an enclosed or semi-enclosed compartment; wherein the extent of flexion of hinges in said closed configuration is defined by protrusions or angled faces on each member such that the faces of such protrusions make contact in closed configuration.

Clause 36. A foldable object in accordance with clause 35 wherein the limit of flexion in said open configuration is defined by the faces of adjacent members which make contact in open configuration.

Clause 37. A foldable object in accordance with clause 35 wherein the object forms a toolbox with space for storing tools located on said grossly flat surface, wherein tools can be concealed and stored when the object is rolled into said closed configuration.

Clause 38. A foldable toolbox in accordance with clause 37 wherein tools are fastened magnetically to said members.

Clause 39. A foldable object in accordance with clause 35 wherein the object forms a game board with gameplay surface on the upper faces of said members when object is in open configuration.

Clause 40. A foldable board in accordance with clause 1 in which said protrusions are replaced by angled faces on each of said members which come into contact with corresponding faces of adjacent members in closed configuration, thus forming said barrier to further folding.

What is claimed:

1. A foldable game board, comprising:

a plurality of elongated base panels, each of the plurality of elongated base panels comprising an inner surface, an outer surface, two opposing ends, and two side panels, each of the two side panels extending upward at a different one of the two opposing ends;

a folding mechanism connecting edgewise each of the plurality of elongated base panels, allowing each of the plurality of elongated base panels to fold against an adjacent elongated base panel to form open and closed configurations;

the open configuration comprising the plurality of elongated base panels lying coplanar, wherein the plurality of inner surfaces forms and displays a game board, the game board comprising a plurality of game spaces, each of the plurality of game spaces being defined as a section of the game board upon which one of a plurality of game pieces is capable of being retained in place;

the closed configuration comprising the plurality of elongated base panels angled to form a hollow structure;

wherein the game board, the plurality of game spaces and the plurality of game pieces are cooperatively configured in order to allow for a current game state to be maintained when the plurality of elongated base panels are disposed from the open configuration to the closed configuration during game play, and to maintain the current game state when the plurality of elongated based panels are disposed from the closed configuration to the open configuration in order to resume the game play.

2. The foldable game board as recited in claim 1, wherein the foldable game board comprises from 3 to 20 elongated base panels.

3. The foldable game board as recited in claim 1, wherein the folding mechanism comprises at least one of:

a hinge;

or a bendable panel.

4. The foldable game board as recited in claim 1, wherein the closed configuration further comprises the ends of the plurality of elongated base panels fastened together by at least one of:

a magnet;

velcro;

a strap:

a rope;

a string;

a button; or a clasp.

5. The foldable game board as recited in claim 1, wherein the plurality of inner surfaces is magnetically attracted to game pieces placed on the game board.

6. The foldable game board as recited in claim 1, wherein the plurality of outer surfaces is rounded such that, in the closed configuration, the plurality of elongated base panels is characterized as having a cylindrical appearance.

7. A foldable game board, comprising:

a plurality of elongated base panels, wherein each of the plurality of elongated base panels comprises an inner surface, an outer surface, and a side panel oriented perpendicularly at each end;

a folding mechanism on each inner surface connecting edgewise each of the plurality of elongated base panels, allowing each of the plurality of elongated base panels to fold against an adjacent elongated base panel to form open and closed configurations;

the open configuration comprising the plurality of elongated base panels lying coplanar, wherein the plurality of inner surfaces forms and displays a game board, the game board comprising a plurality of game spaces, each of the plurality of game spaces being defined as a section of the game board upon which one of a plurality of game pieces is capable of being retained in place;

the closed configuration comprising the plurality of elongated base panels angled to form a hollow structure;

wherein the elongated base panels define a three-dimensional open space above each of the plurality of game spaces, each of the three-dimensional open spaces comprising a base defined by one of the plurality of game spaces and a plurality of side faces extending upward from the base at an angle equal to an angle defined between side edges of a corresponding side panel and a corresponding inner surface;

wherein the three-dimensional open spaces and the plurality of game pieces are cooperatively sized in order to maintain a current game state when the plurality of elongated base panels are disposed from the open configuration to the closed configuration during game play, and to maintain the current game state when the plurality of elongated based panels are disposed from the closed configuration to the open configuration in order to resume the game play.

8. The foldable game board as recited in claim 7, wherein the foldable game board comprises from 3 to 2 ( ) elongated base panels.

9. The foldable game board as recited in claim 7, wherein the folding mechanism comprises at least one of:

a hinge;

or a bendable panel.

10. The foldable game board as recited in claim 7, wherein each side panel of the plurality of elongated base panels are shaped differently.

11. The foldable game board as recited in claim 7, wherein the interlocking of each side panel in the closed configuration is conducted via an interlocking mechanism.

12. The foldable game board as recited claim 11, wherein the interlocking mechanism comprises a locking panel attached to one end of each side panel of the plurality of elongated base panels.

13. The foldable game board as recited in claim 7, wherein the plurality of outer surfaces is rounded such that, in the closed configuration, the plurality of elongated base panels is characterized as having a cylindrical appearance.

14. A foldable game board, comprising:

a plurality of elongated base panels, wherein each of the plurality of elongated base panels comprises a substantially flat inner surface, an outer surface, and a side panel oriented perpendicularly at each end;

a folding mechanism connecting edgewise each of the plurality of elongated base panels, allowing each of the plurality of elongated base panels to fold in one direction against an adjacent elongated base panel to form open and closed configurations, the open configuration comprising the plurality of elongated base panels lying coplanar, wherein the plurality of substantially flat inner surfaces forms and displays a game board, the game board comprising a plurality of game spaces, each of the plurality of game spaces being defined as a section of the game board upon which one of a plurality of game pieces is capable of being retained in place;

the closed configuration comprising the plurality of elongated base panels angled to form a hollow structure;

wherein the elongated base panels define a three-dimensional open space above each of the plurality of game spaces, each of the three-dimensional open spaces comprising a base defined by one of the plurality of game spaces and a plurality of side faces extending upward from the base and an angle equal to an angle defined between side edges of a corresponding side panel and a corresponding inner surface;

wherein each of the plurality of game pieces are sized to substantially fit within one of the three-dimensional open spaces in order to maintain a current game state when the plurality of elongated base panels are disposed from the open configuration to the closed configuration during game play, and to maintain the current game state when the plurality of elongated based panels are disposed from the closed configuration to the open configuration in order to resume the game play.

15. The foldable game board as recited in claim 14, wherein the foldable game board comprises from 3 to 20 elongated base panels.

16. The foldable game board as recited in claim 14, wherein the folding mechanism comprises at least one of:

a hinge;

or a bendable panel.

17. The foldable game board as recited in claim 14, wherein the plurality of inner surfaces is magnetically attracted to game pieces placed on the game board.

18. The foldable game board as recited in claim 14, wherein closed configuration further comprises the ends of the plurality of elongated base panels fastened together by at least one of:

a magnet;

velcro;

a strap;

a rope;

a string;

a button; or a clasp.

* * * * *